US007581895B2

(12) United States Patent
Gutberlet

(10) Patent No.: US 7,581,895 B2
(45) Date of Patent: Sep. 1, 2009

(54) COSMETIC PRODUCT REPLACEMENT UNIT FOR A BASE STICK MODULE OF COSMETIC STICK AS WELL AS A SET CONSISTING OF A COSMETIC PRODUCT REPLACEMENT UNIT OF THIS TYPE AND A PLURALITY OF BASE STICK MODULES

(75) Inventor: Detlev Gutberlet, Altdorf (DE)

(73) Assignee: H & M Gutberlet GmbH, Nuremberg (DE)

( * ) Notice: Subject to any disclaimer, the term of this patent is extended or adjusted under 35 U.S.C. 154(b) by 0 days.

(21) Appl. No.: 11/767,911

(22) Filed: Jun. 25, 2007

(65) Prior Publication Data

US 2007/0297845 A1 Dec. 27, 2007

(30) Foreign Application Priority Data

Jun. 24, 2006 (DE) ..... 20 2006 009 892 U

(51) Int. Cl.
*B43K 21/00* (2006.01)

(52) U.S. Cl. ..... 401/87; 401/66

(58) Field of Classification Search ..... 401/55, 401/65, 66, 75, 82, 84, 85, 87
See application file for complete search history.

(56) References Cited

U.S. PATENT DOCUMENTS 2,529,037 A * 11/1950 Marples ..... 401/55
2,718,299 A * 9/1955 Atwater et al. ..... 206/537
3,989,392 A * 11/1976 Seidler ..... 401/66
5,011,317 A 4/1991 Gueret
6,394,270 B1 * 5/2002 Liu ..... 206/385

FOREIGN PATENT DOCUMENTS

DE 804169 4/1951
DE 9102096 U1 7/1991
DE 4123123 A1 1/1993

* cited by examiner

*Primary Examiner*—Huyen Le
(74) *Attorney, Agent, or Firm*—Browdy and Neimark, P.L.L.C.

(57) ABSTRACT

A cosmetic product replacement unit for a base stick module of a cosmetic stick has a replacement housing in which the cosmetic product is present in the form of a refill. A cap or sealing an extension opening for the refill is attached onto the replacement housing. The refill is in push connection with a piston guided in the replacement housing. A piston connecting component, connected to the piston, may be used with a complementary push rod connecting component of a piston push rod as part of a feed device of the base stick module to withdraw the refill. It is possible to bring the piston push rod into push connection with the piston and to position it on the side of the piston remote from the refill. In addition to the cosmetic product replacement unit, a set also has a plurality of base stick modules which have feed devices for the cosmetic product which differ from one another in their mechanical operating principles. There results a replacement unit which has reduced production costs, and this is also an advantage for the set.

19 Claims, 6 Drawing Sheets

COSMETIC PRODUCT REPLACEMENT UNIT FOR A BASE STICK MODULE OF COSMETIC STICK AS WELL AS A SET CONSISTING OF A COSMETIC PRODUCT REPLACEMENT UNIT OF THIS TYPE AND A PLURALITY OF BASE STICK MODULES

BACKGROUND OF THE INVENTION

1. Field of the Invention

The invention relates to a cosmetic product replacement unit for a base stick module of a cosmetic stick with a replacement housing in which the cosmetic product is present in the form of a refill, with a cap attached onto the replacement housing, for sealing a refill extension opening, configured in the replacement housing, for the refill, wherein the refill is in push connection with a piston guided in the replacement housing. The invention also relates to a set consisting of a cosmetic product replacement unit of this type and a plurality of base stick modules.

2. Background Art

A generic cosmetic product replacement unit is known through prior public use. As soon as the cosmetic product is used up or is not intended to be used any further, the known replacement unit is used as a replacement for a corresponding stick unit, the replacement unit, together with the base stick module, reproducing the complete cosmetic stick.

The replacement units known in the art are expensive to produce.

SUMMARY OF THE INVENTION

It is therefore an object of the present invention to develop a replacement unit of the type mentioned at the outset, such that the production costs for said replacement unit are reduced.

The object is achieved according to the invention by a replacement unit having a piston connecting component, connected to the piston, for cooperating with a complementary push rod connecting component of a piston push rod as part of a feed device of the base stick module for extending the refill, the piston connecting component being designed to bring the piston push rod into a push connection with the piston and to position the piston push rod on the side of the piston remote from the refill.

According to the invention, it has been found that it is unnecessary to install mechanical operational components of the feed device of the cosmetic stick in the replacement unit. These operational components of the feed device are omitted in the replacement unit according to the invention and are fully installed in the base stick module. A simply constructed replacement unit results which accordingly may be produced in a cost-effective manner. The replacement units may be filled, stored and sold separately from the base stick modules with the feed devices. The base stick modules may be completed to produce the complete cosmetic sticks when they reach the customer or immediately before dispatch. The use of the replacement units allows the feed devices to be configured as high-quality mechanisms which may be sold at a suitable price. Mechanisms of this type may be produced, for example, from anodised aluminium. The high-quality mechanisms may be used repeatedly in that new replacement units are reused in each case to replace used-up stick units and are connected to the feed device of the base stick module. It is also possible to provide the replacement units with different cosmetic products, in particular also with different dimensions, for example with different refill diameters. Therefore, when consumers purchase only a single base stick module, they are able to choose between various cosmetic products, for example various colours and also various refill diameters, without purchasing in each case a completely new base stick module for this purpose.

A holding design of the refill being held in a cup-shaped seat in the piston is secure.

A cap which seals the replacement housing on the side of the piston connecting component to store the replacement unit protects the piston.

Connection devices being configured as complementary components of a bayonet connection or of a snap-in connection are secure and are also easily used by an end customer. A further object of the invention is to make the advantages of a replacement unit more comprehensively usable without complex components of feed devices.

This object is achieved according to the invention by a set consisting of a cosmetic product replacement unit having a piston connecting component, connected to the piston, for cooperating with a complementary push rod connecting component of a piston push rod as part of a feed device of the base stick module for extending the refill, the piston connecting component being designed to bring the piston push rod into a push connection with the piston and to position the piston push rod on the side of the piston remote from the refill and consisting of a plurality of base stick modules which have feed devices, which differ from one another in their mechanical operating principles, for the cosmetic product.

According to the invention, it has been found that for a replacement unit which no longer has operational components of a feed device for advancing the refill, it is possible to freely select the type and manner of mechanical construction of these operational components of the feed device. The replacement unit may therefore be used with base stick modules of different mechanical operating principles. The single crucial requirement is to provide compatibility in the connection between the replacement unit and the base stick module.

A feed device of one of the base stick modules which has, in addition to the piston push rod: an actuating push rod in push connection with an actuating element positioned on an end of the actuating push rod opposite the refill extension opening, wherein the actuating push rod is in push connection with the piston push rod via a pair of stops consisting of a first stop positioned on one of the two push rods and a plurality of second stops positioned in succession at an equal distance from one another axially along the other push rod, wherein a stop alternating device using which to advance a refill, the first stop is alternated between a second momentary stop of the second stops, with which the first stop momentarily cooperates, and an axially adjacent second target stop, comprising a driver body, to which the actuating push rod, is attached at least one ramp which is secured to the housing and cooperates with the driver body and the ramp incline of which is such that in an actuating position of the actuating push rod, the first stop disengages from the momentary stop as soon as the driver body has traveled a distance of advancement which at least equals the distance between two adjacent second stops, a pretensioning spring which pretensions the actuating push rod relative to the housing in an unactuated rest position, in which the actuating element is pushed out of the housing, allows a secure feed which may be produced in a convenient manner.

A distribution of the stops, the first stop being positioned on the actuating push rod and the second stops being positioned on the piston push rod, provides a construction of the feed device which may be carried out structurally at low cost.

Alternatively, it is possible to provide the first stop on the piston push rod and the second stops on the actuating push rod.

A set in which the driver body has the first stop provides a compact construction of the feed device, since the functions of "ramp guidance" and "first stop" are combined in a compact manner on the driver body.

Contact portions being formed between the push rods such that a return of the actuating push rod from the actuating position into the rest position is provided by the push rods sliding past one another, without the piston push rod being axially displaced relative to the housing as a result ensure that when the actuating push rod returns from the actuating position into the rest position, the piston push rod is not entrained, in an undesirable manner. Securing the piston push rod in this respect may be further assisted by a suitable friction effect of the piston push rod in a guide provided through a passage opening in a component fixed to the housing.

A pretensioning spring being configured as a plastics material spring provides a simple construction of the cosmetic stick. The plastics material spring may also be produced as an injection moulded part and may integrate various functions. Thus, the plastics material spring may in particular feature an intermediate base into which the passage opening is guided for guiding the movement of the piston push rod. When a plastics material pretensioning spring is used, a bayonet catch in particular is possible for joining on the one hand a cosmetic product housing portion, i.e. a refill housing portion, with on the other hand a feed housing portion, without openings of this connection which are caused for production reasons being visible from outside. A metal spring is not needed.

A ramp according being formed integrally with the pretensioning spring also enhances the compact nature of the arrangement, since an additional function integration takes place.

A guide device for guiding axial movement of the push rods relative to one another provides a reliable and defined relative movement of the push rods during the feed activation.

A feed device of another base stick module comprises in addition to the piston push rod an actuating wheel which projects with a portion of its circumference out of a stick housing of the base stick module and is in push connection with the piston push rod via a deflection gearing. Such a feed device is particularly simple to produce and allows continuous feed of the refill. Actuation of this feed device is also simple.

The construction of the feed device wherein axle journals of the actuating wheel are snapped into snap-in seats of a housing portion which surrounds the actuating wheel and which for its part is connected to the stick housing, and in particular is snapped-in provides particularly easily moulded individual parts. These may be readily produced as injection moulded components.

Embodiments of the invention will be described in more detail in the following with reference to the drawings.

DESCRIPTION OF THE PREFERRED EMBODIMENTS

Figure 2:
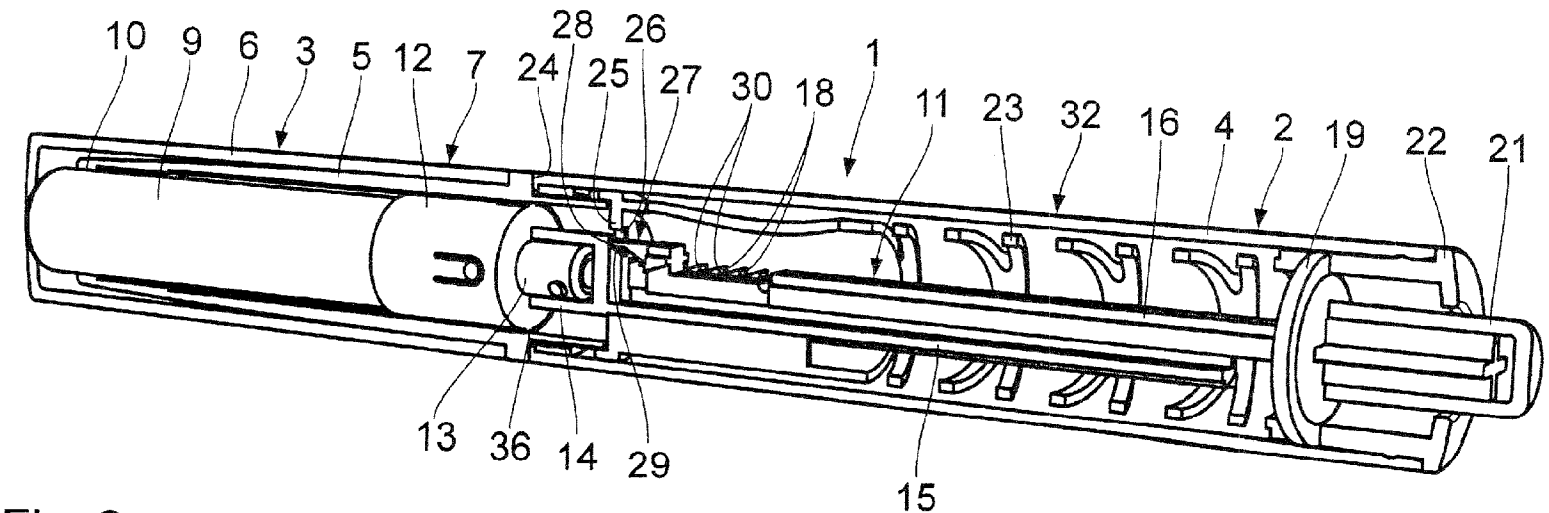
FIG. 2 shows a longitudinal section through the cosmetic stick according to FIG. 1.

A cosmetic stick 1 has a stick housing 2 with a cosmetic product housing portion 3 and a feed housing portion 4. The stick housing 2 with the cosmetic product housing portion 3 and the feed housing portion 4 is manufactured from SAN-ABS. The cosmetic product housing portion 3 has a cone housing body 5 which is covered by a cap 6, for example when the cosmetic stick 1 is stored. FIG. 2 shows the cap 6 pushed onto the cone housing body 5, the cap 6 abutting against a peripheral collar 7 of the cone housing body 5. A slight undercut (not shown in more detail) of the cone housing body 5 and of the cap 6 ensures that the cap 6 is held with a positive fit, and thus secured, on the cone housing body 5 when resting on the peripheral collar 7. At the same time, a user may easily remove the cap 6 from the cone housing body 5.

Adjacent to the peripheral collar 7, the cone housing body 5 has bayonet segments 8 which face the feed housing portion 4 and catch in a corresponding inner peripheral recess in the feed housing portion 4 when the cone housing body 5 is assembled. The bayonet segments 8 form together with the corresponding bayonet seat in the feed housing portion 4 a bayonet catch for joining these two housing components. A latching or snap-in connection is also possible instead of a bayonet catch.

A cosmetic product in the form of a refill 9 is positioned in the cone housing body 5. Said refill 9 may be moved out of the cone housing body 5 through a refill extension opening or refill opening 10 therein. A feed device 11 which is housed in the feed housing portion 4 and will be described in more detail hereinafter is used to extend or withdraw the refill 9.

The refill 9 is in a push connection with a piston 12 guided in the cone housing body 5. In this respect, the refill 9 is held in a cup-shaped seat in the piston 12. The refill 9 has a diameter of 6 mm. The seat in the piston 12 has an inner diameter corresponding thereto. Other refill diameters are also possible. A refill diameter of 8 mm in particular is also possible. Formed integrally with the piston 12 is a piston connecting component 13, the outer diameter of which is reduced in comparison to the outer diameter of the rest of the piston 12. Peripheral seats in a sleeve-shaped connecting component 14 of a piston push rod 15 are formed in a complementary manner to bayonet segments of the piston connecting component 13. The piston push rod 15 is manufactured from POM. The piston push rod 15 is in push connection with the piston 12 and is positioned on the side of the piston 12 remote from the refill 9. A positive, secure connection between the piston 12 and the feed device 11, to which the piston push rod 15 belongs, is produced via the bayonet connection formed by the connecting components 13 and 14.

An actuating push rod 16 also belongs to the feed device 11. Said actuating push rod 16 is in push connection with the piston push rod 15. The actuating push rod 16 is manufactured from POM. Said push connection is produced via a pair of stops consisting of a first stop 17 positioned on the actuating push rod 16 and a plurality of second stops 18 positioned in succession at an equal distance from one another axially along the piston push rod 15. In the feed position shown in FIG. 2, the first stop 17 of the actuating push rod 16 cooperates with the second stop 18 arranged furthest to the left as shown in FIG. 2, so that the refill 9 is in a starting position with the piston 12 fully retracted into the stick housing 2.

Overall, there are two rows of second stops 18 at the same height, between which runs the actuating push rod 16.

Where the actuating push rod 16 runs between the two rows of second stops 18 up to the end of the piston push rod 15 facing the stop point 19, the two push rods 15, 16 are guided towards one another so that a defined relative movement of the two push rods 15, 16 with respect to one another is possible. This guidance is carried out by a complementary cross-sectional configuration of adjacent portions of the push rods 15, 16. This guide means is a T groove guide.

On its side remote from the piston 12, the actuating push rod 16 has a contact peripheral collar 19. The outer diameter of the contact peripheral collar 19 corresponds to the inner diameter of the feed housing portion 4. A free end 20, adjacent to the contact peripheral collar 19, of the actuating push rod 16 bears an operating button 21 as actuating element which is latched or snapped onto the free end 20. The operating button 21 protrudes, like an operating button for a ballpoint pen, out of the end, opposite the refill 9, of the feed housing portion 4. Latched into a housing opening in the feed housing portion 4, from which the operating button 21 protrudes, is a stopper 22 which is shaped like a sleeve and is penetrated by the operating button 21. The operating button 21 is made of SAN-ABS, as is the stopper 22. An inner end wall of the stopper 22 rests against the contact peripheral collar 19 of the actuating push rod 16. A plastics material pretensioning spring 23 rests against the contact peripheral collar 19 on the side opposite the stopper 22. The plastics material pretensioning spring 23 is made of POM. At its opposite free end, the plastics material pretensioning spring 23 is supported against an inwardly projecting peripheral collar 24 of the feed housing portion 4. This peripheral collar 24 is closely adjacent to a dividing line between the feed housing portion 4 and the cone housing body 5.

The plastics material pretensioning spring 23 has an intermediate base 25 adjacent to the end wall of the free end, carrying the bayonet segments 8, of the cone housing body 5. The intermediate base 25 has an approximately rectangular passage opening 26 through which the piston push rod 15 passes.

A stop alternating device 27 is a component of the feed device 11. To advance the refill 9, the stop alternating device alternates the first stop 17 between one of the second stops 18, with which the first stop 17 momentarily cooperates and which is also called the second momentary stop, and an axially adjacent further second stop 18 which is also called the target stop. The stop alternating device has a driver body 28 formed integrally on the free end, facing the piston 12, of the actuating push rod 16. The driver body 28 supports the two first stops 17, positioned at the same height, on both sides like wing stumps.

A ramp 29 cooperates with the driver body 28. Said ramp 29 is configured in the intermediate base 25 of the plastics material pretensioning spring 23 which in turn is fixed on the feed housing portion 4. The ramp 29 is therefore fixed on the stick housing 2.

The plastics material pretensioning spring 23 also belongs to the stop alternating device 27.

The second stops 18 positioned axially in succession at an equal distance from one another are configured in the manner of saw teeth. The flank of this saw tooth configuration which is steep in each case and vertical in practice forms the second stops 18. Oblique wall portions 30 run between these vertical wall portions. The incline of these oblique wall portions 30 with respect to a longitudinal axis of the stick housing 2 is sufficiently low for the wing stumps of the driver body 28 to be able to slide on the oblique wall portions 30 in a direction opposite the feed direction, without the piston push rod 15 being axially displaced relative to the stick housing 2 as a result.

The cosmetic stick is assembled as follows:

First of all, the plastics material pretensioning spring 23 is pushed into the feed housing portion 4 until it meets the stop collar 24. A ridge on the stopper side of the feed housing portion 4 cooperating with a corresponding groove in the periphery of the plastics material pretensioning spring 23 ensures that the plastics material pretensioning spring 23 can be pushed into the feed housing portion 4 only in a predetermined orientation. The inner diameter of the feed housing portion 4 is coordinated with the outer diameter of the plastics material pretensioning spring 23, such that both parts easily clamp together in the final assembly position. The piston push rod 15 is then introduced into the plastics material pretensioning spring 23. This is carried out from the left-hand side in FIG. 2. In this respect, the position and the cross-section of the passage opening 26 allow only a correct introduction orientation of the piston push rod 15 into the plastics material pretensioning spring 23. The piston push rod 15 is introduced into the plastics material pretensioning spring 23 until the push rod connecting component 14 of the piston push rod 15 abuts the intermediate base 25 of the plastics material pretensioning spring 23. The actuating push rod 16, already provided with the attached operating button 21, is then inserted into the feed housing portion 4 from the right-hand side in FIG. 2 and threaded in a guiding manner into the complementary guide of the piston push rod 15.

Figure 3:
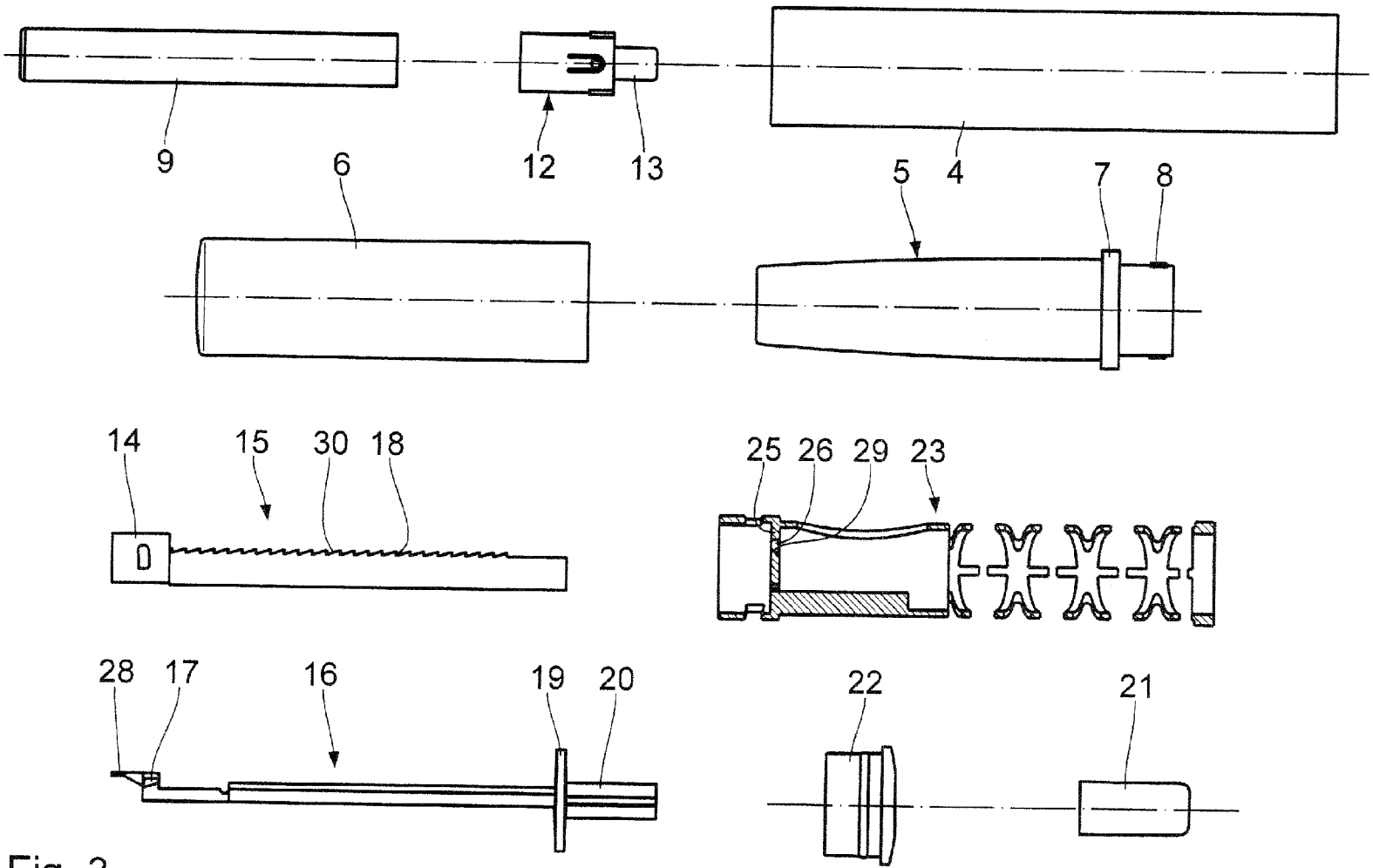
FIG. 3 shows comparable to an exploded view, all the individual components for assembling the cosmetic stick according to FIG. 1.

When the actuating push rod 16 is pushed into the feed housing portion 4, the first stop 17 of the actuating push rod 16 engages initially with the second stop 18, located furthest to the right as shown in FIG. 3, of the piston push rod 15. During further insertion, the actuating push rod 16 pushes the piston push rod 15 ahead of it until the driver body 28 of the actuating push rod 16 runs onto the ramp 29. In so doing, the first stop 17 disengages from the second momentary stop 18. The piston push rod 15 may then be pushed back toward the right as shown in FIG. 2 until it reaches the starting position. The stopper 22 is then pushed and latched into the feed housing portion 4. In so doing, the plastics material spring is pretensioned slightly between the peripheral collar 19 and the peripheral collar 24.

When the operating button 21 is actuated, in other words when the operating button is pushed into the stick housing 2, the piston push rod 15 is advanced by the actuating side rod 16 through the engagement of the first stop 17 with the second momentary stop 18, initially by a distance of advancement which at least equals the distance between two second stops 18. After this distance of advancement, the driver body 28 has run onto the ramp 29 to such an extent that the first stop 17 disengages from the second momentary stop 18. Further advancement of the piston push rod 15 therefore does not take place, irrespective of whether the operating button 21 is pressed further into the stick housing 2. When the operating button 21 is released, it is pushed back again into the rest position shown in FIG. 2 due to the pretension of the plastics material pretensioning spring 23 until the peripheral collar 19 rests against the stopper 22. During this pushing back action, the driver body 28 slides on the oblique wall portions 30 of the piston slide rod 15. In so doing, the piston slide rod 15 is not displaced axially relative to the stick housing 2, such that in the rest position of the operating button 21, the first stop 17 is then able to engage with the second target stop 18 which is axially adjacent to the previous second momentary stop 18, more specifically is axially adjacent on the right-hand side in FIG. 2.

Figure 4:
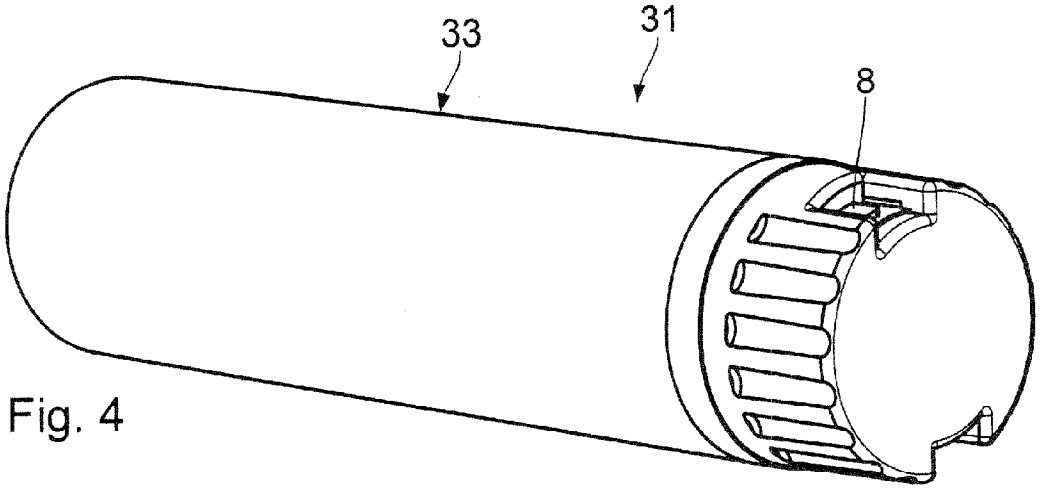
FIG. 4 shows a perspective view of a cosmetic product replacement unit for a base stick module of the cosmetic stick according too FIG. 1 to 3.
Figure 5:
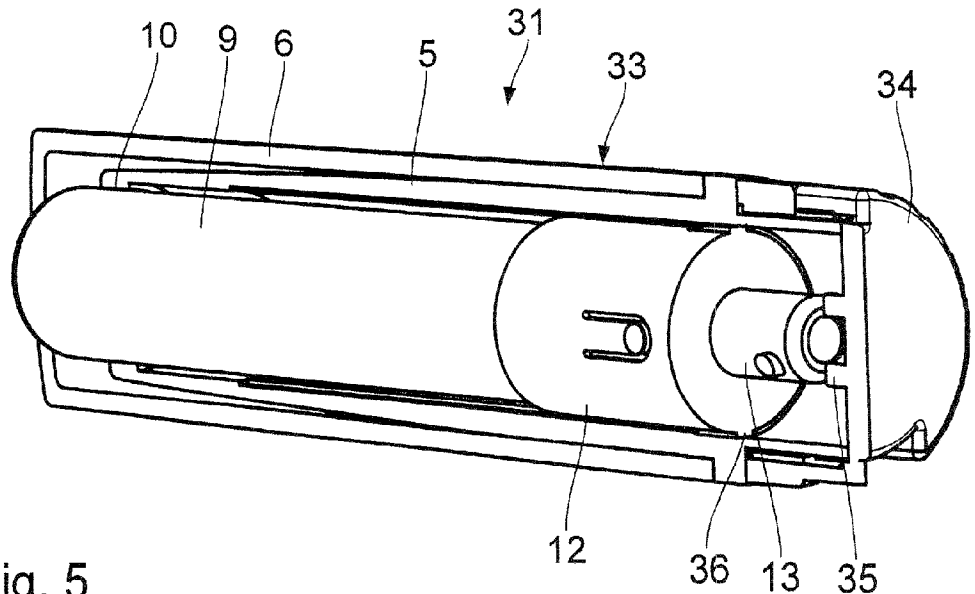
FIG. 5 shows an axial longitudinal section through the cosmetic product replacement unit according to FIG. 4.
Figure 6:
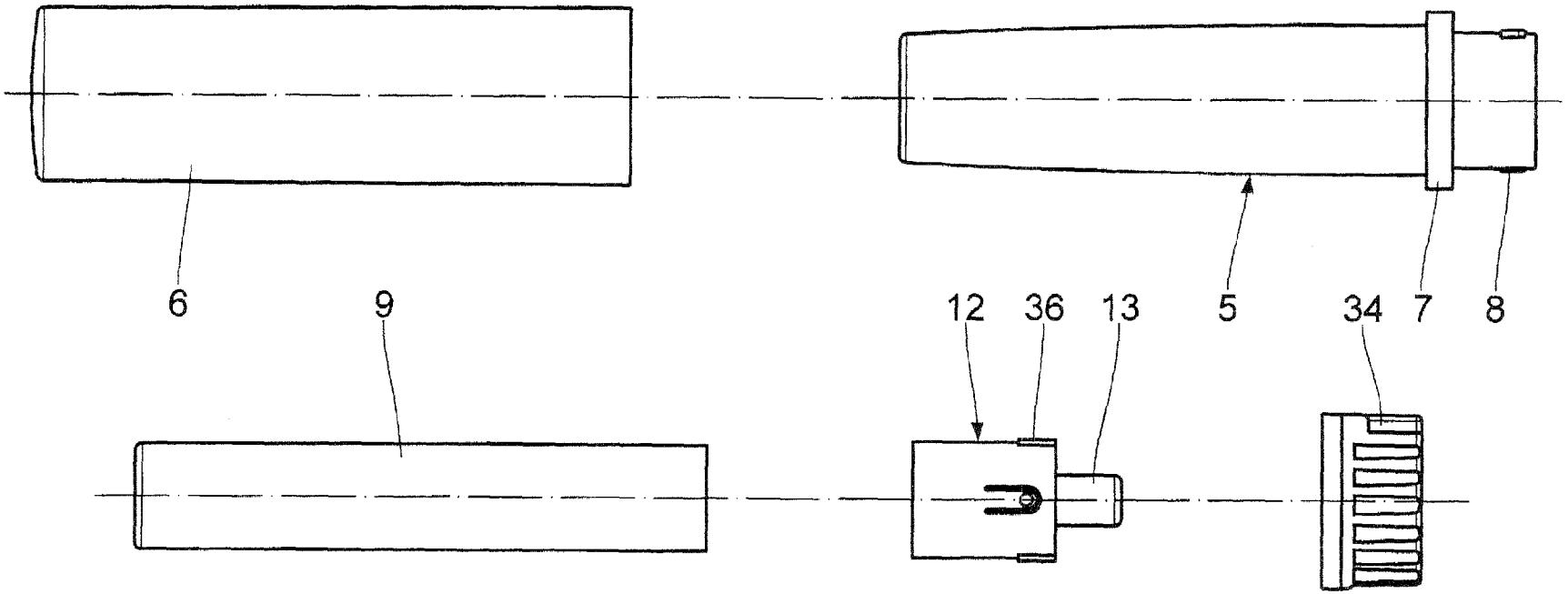
FIG. 6 shows a view similar to that of FIG. 1 of the cosmetic product replacement unit.

FIG. 4 to 6 show a cosmetic product replacement unit 31 for a base stick module 32 of the cosmetic stick 1. The base stick module 32 includes all the components of the cosmetic stick 1 except for the cosmetic product housing portion 3, the piston 12 and the refill 9.

The cosmetic product replacement unit 31 has a replacement housing 33 which is identical to the cosmetic product housing portion 3, i.e. it has the cone housing body 5 and the cap 6. A sealing cap 34 attached to the replacement housing 33 and secured thereto via a bayonet catch seals the replacement housing 33 on the side of the piston 12. The sealing cap 34 is made of polypropylene (PP). A support 35 formed integrally with the base of a sealing cap 34 in the region of the stick housing longitudinal axis is used for the defined contact positioning of the piston connecting component 13. Positioned in the replacement housing 33 of the cosmetic product replacement unit 31 are the refill 9 and the piston 12 in the same orientation and position to the cone housing body 5 as in the cosmetic product housing portion 3 of the cosmetic stick 1.

The cosmetic product replacement unit 31 is assembled as follows:

First of all, the piston 12 is pushed, with the guiding seat opening, into the cone housing body 5, more specifically from the side on which the bayonet segments 8 are located in the cone housing body 5. Ridges 36 formed integrally with the outer wall of the piston 12 run in axial grooves in the inner wall of the cone housing body 5, such that the piston 12 is safeguarded against twisting in the cone housing body 5. A latching formed by complementarily formed snap-in elements on the piston 12 on the one hand and on the cone housing body 5 on the other hand indicates the assembly end position of the piston 12 in the cone housing body 5. The sealing cap 34 is then fitted on the cone housing body 5 via the bayonet connection. The refill 9 is then introduced into the seat of the piston 12 and finally the cap 6 is placed on the cone housing body 5.

To replace a cosmetic product housing portion 3 with a new cosmetic product replacement unit 31 when the refill 9 is used up, the bayonet connection between the cosmetic product housing portion 3 and the feed housing portion 4 is released. The sealing cap 34 is removed from the cosmetic product replacement unit 31 and the replacement unit 31 is connected to the feed housing portion 4 of the cosmetic stick 1. In so doing, a bayonet connection is simultaneously produced between the replacement housing 33 and the feed housing portion 4 on the one hand and between the piston connecting component 13 and the push rod connecting component 14. The cosmetic stick 1 is then ready for use again with a new refill 9.

Figure 7:
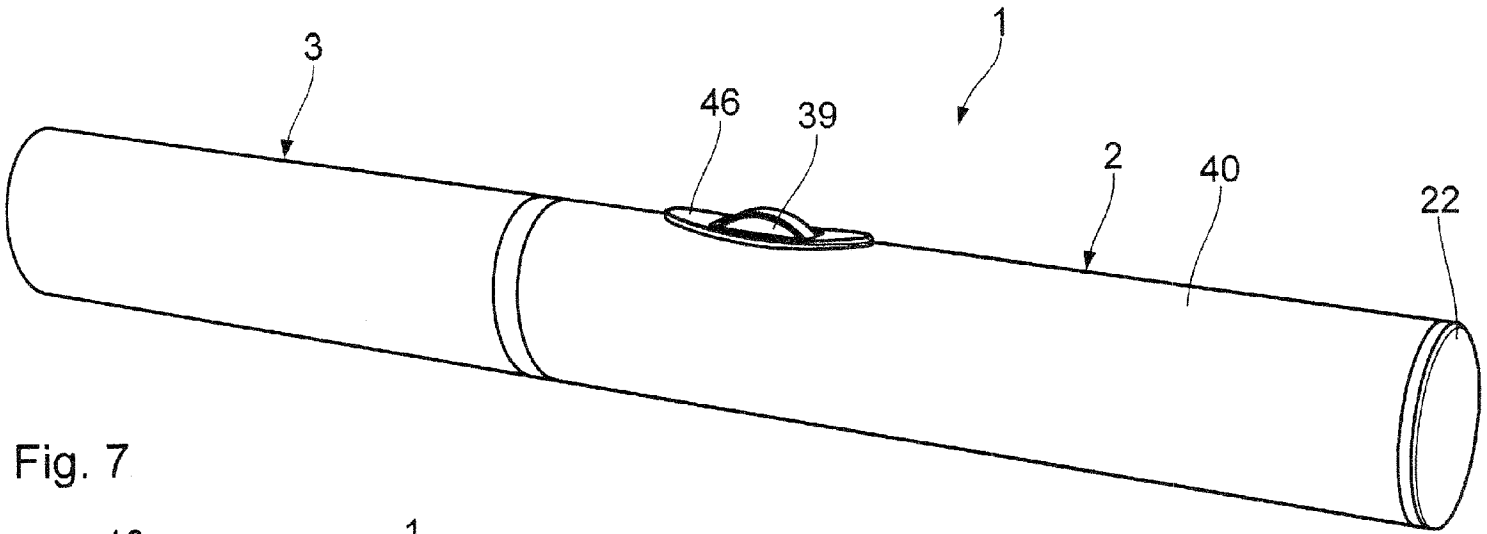
FIG. 7 shows a perspective side view of another cosmetic stick with a different base stick module which has a feed device for the cosmetic product, which feed device differs in respect of its mechanical operating principles from the feed device of the base stick module of the cosmetic stick according to FIG. 1.
Figure 8:
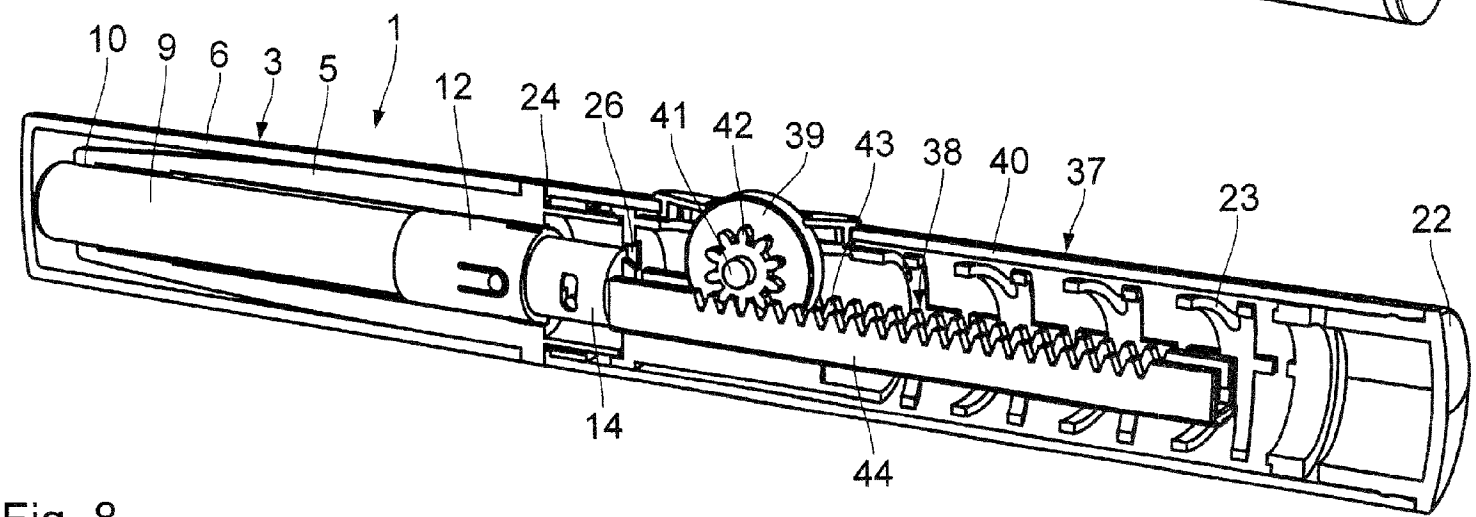
FIG. 8 shows an axial longitudinal section of the cosmetic stick according to FIG. 7.
Figure 9:
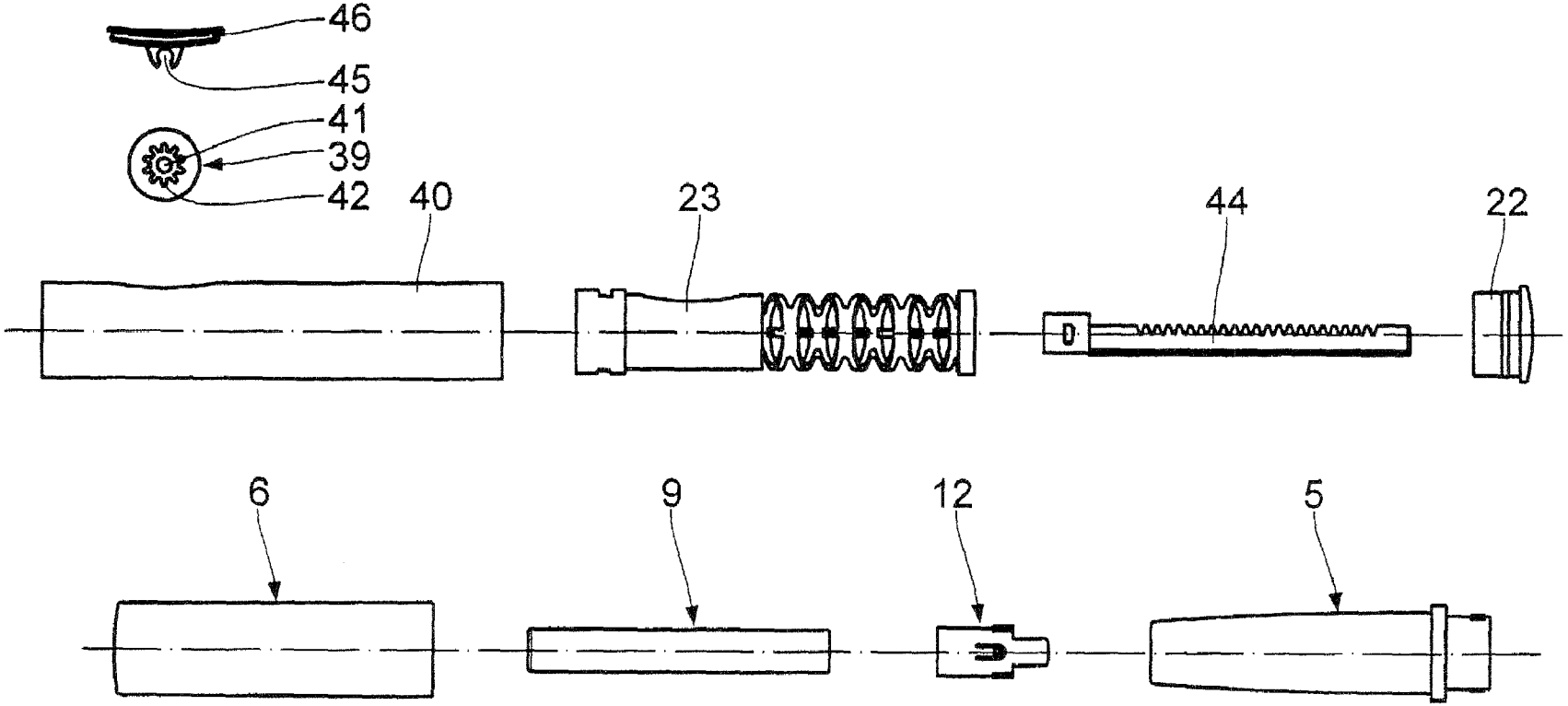
FIG. 9 shows a view, similar to FIG. 3, of the individual components of the cosmetic stick according to FIG. 7.

FIG. 7 to 9 show another variant of a cosmetic stick in which the cosmetic product replacement unit 31 may also be used. Components corresponding to those previously described with reference to FIG. 1 to 6 have been given the same reference numerals and will not be described again in detail.

A base stick module 37 of the cosmetic stick according to FIG. 7 to 9 has a feed device 38 with an actuating wheel 39. A portion of the circumference of the actuating wheel protrudes out of a feed housing portion 40 of the cosmetic stick 1 according to FIG. 7 to 9. The actuating wheel 39 is made of SAN-ABS, as is the feed-housing portion 40. Gear wheels 42 are formed integrally in each case with the actuating wheel 39 on axle journals 41 guided on both sides out of the actuating wheel 39. The gear wheels 42 mesh with two rack portions 43 running parallel to each other of a piston push rod 44 of the cosmetic stick 1 according to FIG. 7 to 9. The piston push rod 44 is made of POM. Formed integrally with the rack portions 43 facing the piston 12 is the push rod connecting body 14 which is configured identically to the push rod connecting body 14 of the embodiment according to FIG. 1 to 3. The piston push rod 44 here again passes through the passage opening 26 in the plastics material pretensioning spring 23.

The axle journals 41 of the actuating wheel 39 are latched into snap-in seats 45 of a screen housing portion 46. The screen housing portion 46 is made of SAN-ABS. The screen housing portion 46 which surrounds the actuating wheel 39 is here again latched into a seat in the feed housing portion 40.

For the assembly of the cosmetic stick 1 according to FIG. 7 to 9, the plastics material pretensioning spring 23 is also initially introduced into the feed housing portion 40, as described in connection with the assembly of the cosmetic stick 1 according to FIG. 1 to 3. The stopper 22 is then pushed from the right-hand side in FIG. 8 into the feed housing portion 40 and is latched or snapped-in therein. The piston push rod 44 is then introduced into the plastics material pretensioning spring 23 through the passage opening 26 from the left-hand side in FIG. 8. The actuating wheel 39 is latched into the snap-in seat 45 in the screen housing portion 46 and the screen housing portion 46 is then latched into the seat in the feed housing portion 40. By turning the actuating wheel 39, the refill 9 may be pushed out of the refill opening 10 or may be pushed back again into the stick housing 2.

Figure 1:
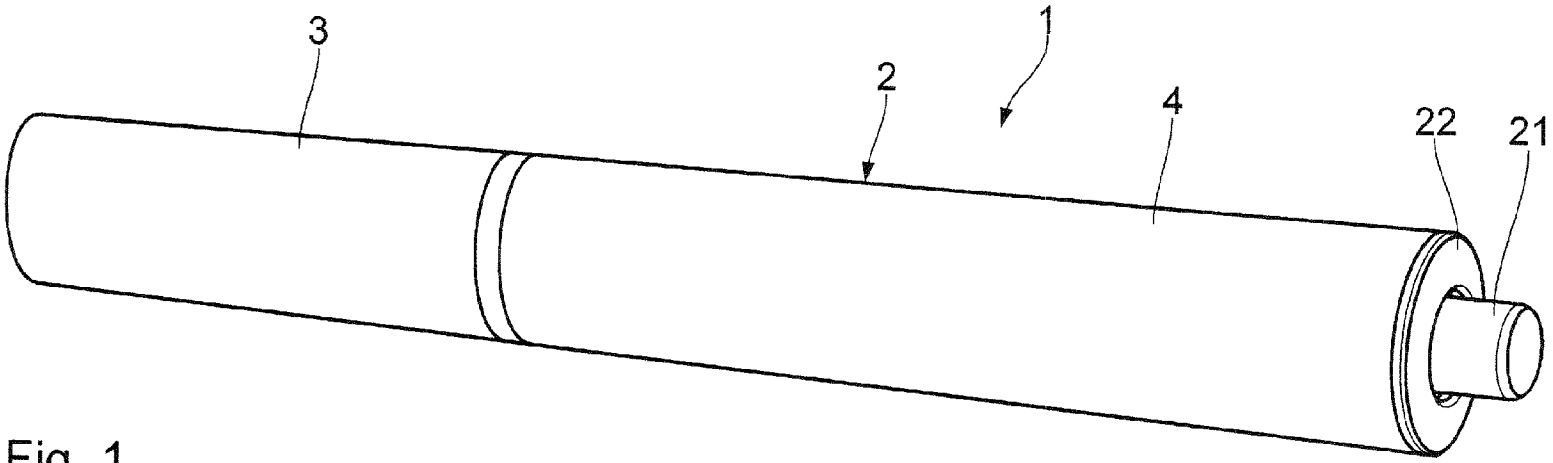
FIG. 1 shows a perspective view of a cosmetic stick.

In both embodiments, i.e. in the embodiment according to FIG. 1 to 3 with the operating button 21 to advance the refill and in the embodiment according to FIG. 7 to 9 with the actuating wheel 39 to advance the refill, the profile cross-section of the piston slide rod 15 and 44 respectively is coordinated with the inner cross-section of the passage opening 26 in the plastics material pretensioning spring such that a friction action occurs in the guide through the passage opening 26 during the movement of the piston push rods 15 and 44 respectively. In the embodiment according to FIG. 1 to 3, this friction is greater than the friction between the piston push rod and the actuating push rod 16. This helps so that during the return of the actuating push rod 16 from the actuating position into the rest position, the piston push rod 15 is not entrained by the actuating push rod 16 in an undesirable manner. In the embodiment according to FIG. 7 to 9, the effect of the friction between the piston push rod 44 and the inner wall of the passage opening 26 is that a certain axial pressure may be exerted on the refill 9 during use, without this resulting in the refill 9 being pushed back undesirably into the stick housing 2.

In a variant of the cosmetic stick 1 according to FIG. 7 to 9 (not shown), the actuating wheel 39 does not have two lateral gear wheels 42; instead there are provided two rotationally engaged wheel portions which are positioned parallel to one another and between which is positioned a gear wheel portion which is rotationally engaged with both wheel portions. The gear wheel portion then meshes with an associated rack portion of a piston push rod of the alternative cosmetic stick. Unlike the piston push rod 44 of the cosmetic stick according to FIG. 7 to 9, the piston push rod of this alternative variant has precisely one rack portion. A comparable actuating wheel with two wheel portions is known from EP 0 714 638 B1 and is used in that publication for an applicator for dental restorative material.

What is claimed is:

1. A cosmetic product replacement unit for separate a base stick module of a cosmetic stick, said cosmetic replacement unit being adapted to be combined together with the separate base stick module to form a complete cosmetic stick, the cosmetic replacement unit comprising:

a replacement housing in which the cosmetic product is present in the form of a refill, a cap attached onto the replacement housing, for sealing a refill extension opening configured in the replacement housing for the refill, a piston, wherein the refill is in push connection with the piston guided in the replacement housing, a connecting component, connected to the piston, the connecting component cooperating with a complementary push rod connecting component of a piston push rod as part of a feed device of the separate base stick module for extending the refill, the piston connecting component being adapted to bring the piston push rod into a push connection with the piston and to position the piston push rod on the side of the piston remote from the refill, and a plurality of base stick modules which have feed devices, which differ from one another in their mechanical operating principles, for the cosmetic product.

2. A replacement unit according to claim 1, wherein the refill is held in a cup-shaped seat in the piston.

3. A replacement unit according to claim 1, comprising a sealing cap which seals the replacement housing on the side of the piston connecting component to store the replacement unit.

4. A replacement unit according to claim 1, wherein the piston connecting component and the push rod connecting component are configured as complementary components of a bayonet connection.

5. A replacement unit according to claim 1, wherein the piston connecting component and the push rod connecting component are configured as complementary components of a snap-in connection.

6. A set according to claim 1, wherein the feed device (11) of one of the base stick modules (32) has, in addition to the piston push rod:

an actuating push rod (16) in push connection with an actuating element (21) positioned on an end of the actuating push rod (16) opposite the refill extension opening (10), wherein the actuating push rod (16) is in push connection with the piston push rod (15) via a pair of stops (17, 18) consisting of a first stop (17) positioned on one of the two push rods (15, 16) and a plurality of second stops (18) positioned in succession at an equal distance from one another axially along the other push rod (16, 15), wherein a stop alternating device (27) using which to advance a refill, the first stop (17) is alternated between a second momentary stop of the second stops (18), with which the first stop (17) momentarily cooperates, and an axially adjacent second target stop (18), comprising a driver body (28), to which the actuating push rod (16), is attached at least one ramp (29) which is secured to the housing (2) and cooperates with the driver body (28) and the ramp incline of which is such that in an actuating position of the actuating push rod (16), the first stop (17) disengages from the momentary stop (18) as soon as the driver body (28) has traveled a distance of advancement which at least equals the distance between two adjacent second stops (18), a pretensioning spring (23) which pretensions the actuating push rod (16) relative to the housing (2) in an unactuated rest position, in which the actuating element (21) is pushed out of the housing (2).

7. A set according to claim 1, wherein the first stop (17) is positioned on the actuating push rod (16) and the second stops (18) are positioned on the piston push rod (15).

8. A set according to claim 7, wherein the driver body (28) has the first stop (17).

9. A set according to claim 1, wherein contact portions (17, 30) are formed between the push rods (15, 16) such that a return of the actuating push rod (16) from the actuating position into the rest position is provided by the push rods (15, 16) sliding past one another, without the piston push rod (15) being axially displaced relative to the housing as a result.

10. A set according to claim 1, wherein the pretensioning spring (23) is configured as a plastics material spring.

11. A set according to claim 1, wherein the ramp (30) is formed integrally with the pretensioning spring (23).

12. A set according to claim 1, wherein the push rods (15, 16) have, at least in certain portions, a guide means for guiding their axial movement relative to one another.

13. The replacement unit according to claim 1, further comprising a connector at one end of the replacement unit adapted for connecting the replacement unit to the separate base stick module when brought together.

14. A set consisting of a cosmetic product replacement unit and a plurality of base stick modules which have feed devices, which differ from one another in their mechanical operating principles, for the cosmetic product, said cosmetic replacement unit comprising:

a replacement housing in which the cosmetic product is present in the form of a refill, a cap attached onto the replacement housing, for sealing a refill extension opening, configured in the replacement housing, for the refill, wherein the refill is in push connection with a piston guided in the replacement housing, and a connecting component connected to the piston, for cooperating with a complementary push rod connecting component of a piston push rod as part of a feed device of the base stick module for extending the refill, the piston connecting component being designed to bring the piston push rod into a push connection with the piston and to position the piston push rod on the side of the piston remote from the refill.

15. A set according to claim 14, wherein the feed device of another base stick module in addition to the piston push rod comprises:

an actuating wheel, which projects with a portion of its circumference out of a stick housing of the base stick module and is in push connection with the piston push rod via a deflection gearing.

16. A set according to claim 15, further comprising axle journals of the actuating wheel snapped into snap-in seats of a housing portion which suffounds the actuating wheel, the housing portion being connected to the stick housing.

17. A set according to claim 16, wherein the housing portion is snapped into the stick housing.

18. A cosmetic product replacement unit to be combined together with a base stick module to form a cosmetic stick, comprising:

a replacement housing in which the cosmetic product is present in the form of a refill, a piston guided in the replacement housing, said refill being inserted in said replacement housing so as to be in push connection with said piston, connecting component, connected to the piston, for cooperating with a complementary push rod connecting component of a piston push rod as part of a feed device of the base stick module for extending the refill, the piston connecting component being designed to bring the piston push rod into a push connection with the piston and to position the piston push rod on the side of the piston remote from the refill, and a cap removably attached onto the replacement housing on a side of the connecting component for sealing a refill extension opening configured in the replacement housing into which the refill is inserted, a sealing cap removably connected on a side of the connecting component and configured to be removed when said replacement housing is to be connected to the base stick module, and a connector at one end of the replacement unit adapted for connecting the replacement unit to the separate base stick module when brought together.

19. A set consisting of a cosmetic product replacement unit according to claim 18 and at least one base stick module comprising said feed device for extending the cosmetic product.

* * * * *